United States Patent [19]

Schexnayder

[11] 4,102,250

[45] Jul. 25, 1978

[54] LOAD CHECK AND BYPASS VALVE

[75] Inventor: Lawrence F. Schexnayder, Joliet, Ill.

[73] Assignee: Caterpillar Tractor Co., Peoria, Ill.

[21] Appl. No.: 714,448

[22] Filed: Aug. 16, 1976

[51] Int. Cl.[2] ..... F15B 11/00; F15B 13/00

[52] U.S. Cl. ..... 91/412; 91/413; 91/414; 91/452; 91/454; 137/596.15; 137/881

[58] Field of Search ..... 91/414, 454, 171, 448, 91/452, 412, 447, 413; 137/596.14, 596.15, 881

[56] References Cited

U.S. PATENT DOCUMENTS

| | | | |
|---|---|---|---|
| 2,922,401 | 1/1960 | Hromas | 91/454 |
| 3,054,384 | 9/1962 | Darling | 91/447 |
| 3,411,295 | 11/1968 | Byers, Jr. | 91/414 |
| 3,612,088 | 10/1971 | McBurnett | 91/454 |
| 3,777,899 | 12/1973 | Witwer | 91/454 |
| 3,800,670 | 4/1974 | Hufeld | 91/454 |
| 3,906,838 | 9/1975 | Hofer | 91/413 |
| 3,922,954 | 12/1975 | Gustafsson | 91/412 |
| 3,977,301 | 8/1976 | Kroth | 91/414 |
| 3,980,000 | 9/1976 | Iijima | 91/454 |
| 3,998,134 | 12/1976 | Budzich | 91/414 |

*Primary Examiner*—Martin P. Schwadron

*Assistant Examiner*—Abraham Hershkovitz

*Attorney, Agent, or Firm*—John W. Grant

[57] ABSTRACT

A load check and bypass valve includes a check valve providing fluid flow from an inlet-outlet port to a motor port while blocking reverse flow therethrough and a bypass valve resiliently biased to a closed position for blocking fluid flow through a bypass connecting the motor port with the inlet-outlet port. The bypass valve has an opened position permitting fluid flow therethrough and is movable to its opened position by a selectively controllable actuating device. A first force exerting device is provided for exerting a force on the bypass valve urging it towards its opened position and is connected to the motor port by a first passage. A second force exerting device is provided for exerting a force on the bypass valve urging it towards its closed position and is connected to the motor port through a second passage. A check valve is disposed in the second passage providing fluid flow therethrough from the motor port to the second force exerting device while blocking reverse fluid flow therethrough. An orifice communicates with the second passage between the check valve and the second force exerting device.

13 Claims, 1 Drawing Figure

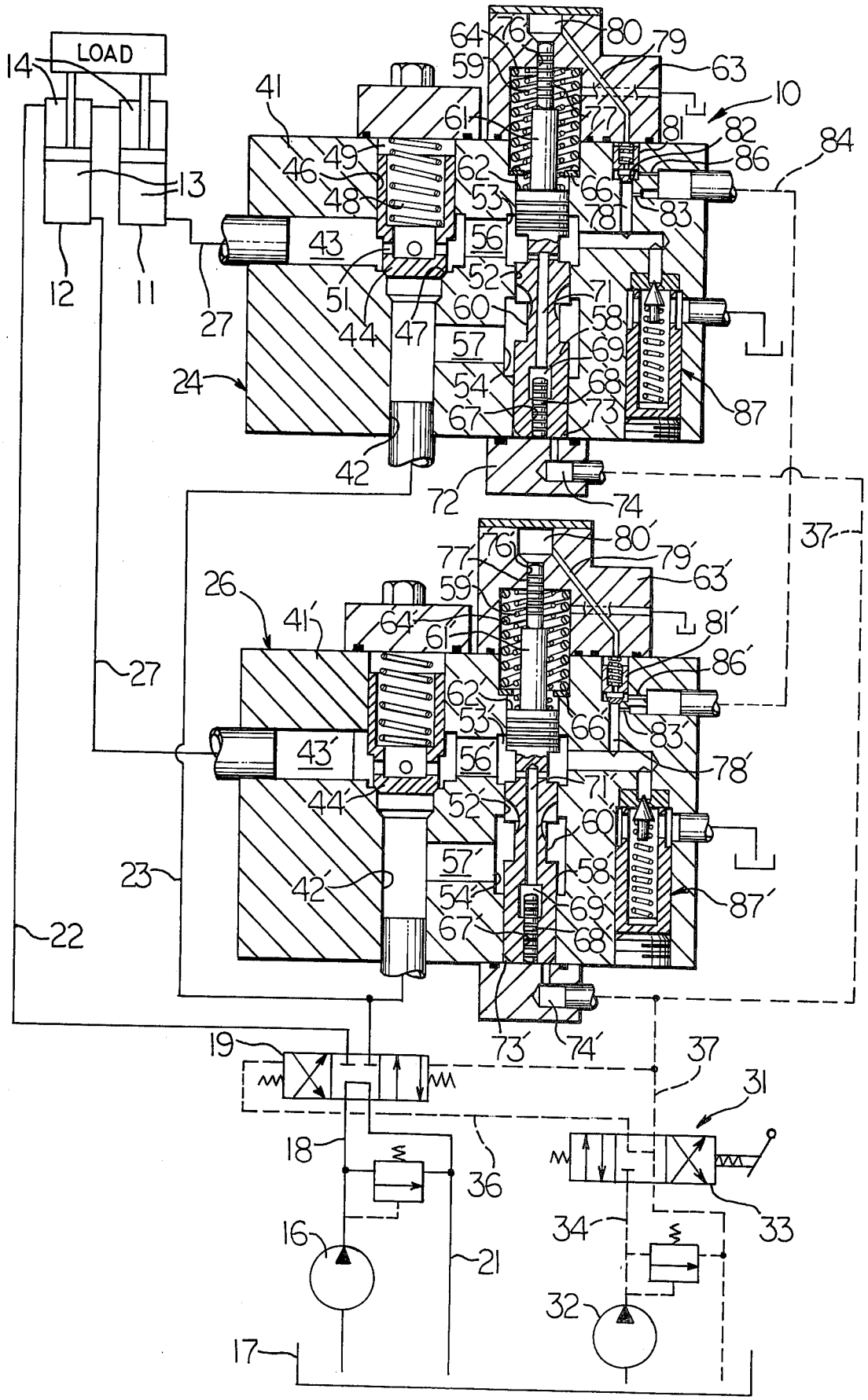
LOAD
14
13
12
11
27
41
46
49
48
43
51
44
47
24
42
64
76
59
80
79
63
10
61
77
81
82
86
84
62
53
66
78
83
56
52
60
71
58
57
69
54
68
67
73
87
72
74
37
26
41'
64'
76'
77'
59'
80'
79'
63'
61'
81'
86'
62'
53'
66'
83'
43'
56'
78'
44'
52'
71'
60'
57'
58'
42'
54'
69'
67'
68'
87'
23
22
73'
74'
19
37
31
18
36
33
34
16
21
32
17

LOAD CHECK AND BYPASS VALVE

BACKGROUND OF THE INVENTION

Hydraulic systems frequently employ a hydraulic motor to raise and lower relatively heavy loads and at times to support such loads in an elevated position. When the motor is required to support the load in such elevated position, it is normally desirable to isolate the relatively high load generated pressure in the load supporting end of the motor from the remainder of the system. This is to prevent the downward drifting of the load due to leakage past the valve spools of the conventional control valves normally used in such systems. The load pressure is also normally isolated to prevent the sudden dropping of the load in the event of a line failure or the like.

This isolation is normally accomplished by the disposition of a load check valve in the motor line near or preferably at the load supporting end of the motor. Such load check valve permits free flow of fluid to the motor but normally prevents the escape of fluid therefrom. In some of such systems, a bypass valve is provided adjacent the check valve to bypass fluid therearound for lowering the hydraulic motors.

In earthmoving vehicles such as hydraulic excavators and the like where two or more hydraulic motors are connected to a boom to operate in unison for raising and lowering the load, a load check-bypass valve combination is sometimes mounted to each of the hydraulic motors. It is desirable that the fluid pressure in the motors be substantially equal to prevent uneven operation and distortion of the excavator boom. However, due to manufacturing tolerances, it has heretofore been a problem of assuring that the bypass valves open simultaneously and equally so that the fluid pressure in the motors remain equal during lowering. For example, when the boom is being lowered slowly, one bypass valve may open slightly before the other bypass valve opens, permitting the fluid pressure in the fluid motor controlled by the one bypass valve to decay rapidly with a corresponding increase in the fluid pressure in the other hydraulic motor since it then carries more of the load.

SUMMARY AND OBJECTS OF THE INVENTION

Accordingly, it is an object of this invention to provide an improved load check and bypass valve for use in a hydraulic load lifting system for substantially equalizing the pressures between a pair of hydraulic motors which are used in unison to raise and lower a load.

Other objects and advantages of the present invention will become more readily apparent upon reference to the accompanying drawings and following description.

BRIEF DESCRIPTION OF THE DRAWING

The sole FIGURE is a cross sectional view of a pair of load check and bypass valves embodying the principles of the present invention incorporated in a schematic circuit diagram of a hydraulic load lifting system.

DESCRIPTION OF THE PREFERRED EMBODIMENT

Referring more particularly to the drawing, a hydraulic load lifting system is indicated by the reference numeral 10 and includes a pair of hydraulic lift motors 11 and 12. Each of the hydraulic jacks includes a load supporting or head end 13 and an opposite rod end 14 with the rod end being connected to a common load. A main pump 16 is connected to a fluid reservoir 17 for drawing fluid therefrom and directing such fluid through a pump line 18 to a pilot operated main control valve 19. Fluid exhausted from the main control valve is returned to the reservoir by way of a tank line 21. A conduit 22 connects the control valve to the rod end of the hydraulic jacks while another conduit 23 connects the control valve with a pair of load check and bypass valves 24 and 26 which are, in turn, connected to the head ends of the lift motors 11 and 12 through a pair of conduits 27.

A pilot control system 31 is provided for selectively simultaneously controlling the operation of the main control valve 19 and the load check and bypass valves 24 and 26. The pilot system includes a pilot pump 32 connected for drawing fluid from the reservoir 17 for supplying pressurized fluid to a pilot selector valve 33 through a pilot line 34. The pilot selector valve is connected with the opposite ends of the main control valve through a pair of pilot lines 36 and 37. The pilot line 37 is also connected to the load check and bypass valves. The pilot selector valve is of the modulating type so as to be able to direct variable amounts of pilot pressure to the main control valve and the load check and bypass valves.

Although the load check and bypass valves 24 and 26 are illustrated as being somewhat spaced from the hydraulic motors 11 and 12, they are preferably mounted directly on their respective hydraulic motors or integral therewith to alleviate the possibility of a line failure between the motors and the load check and bypass valve. The load check and bypass valves are identical in construction and only the load check and bypass valve 24 will be described in detail with primed reference numerals applied to counterpart elements of the load check and bypass valve 26.

The load check and bypass valve 24 includes a valve body 41 having an inlet-outlet port 42 connected to the conduit 23, and a motor port 43 connected to the conduit 27. A check valve member 44 is slidably disposed in a bore 46 and is biased to a closed position against a seat 47 by a spring 48 and fluid pressure in a control chamber 49 behind the check valve member. The control chamber is pressurized by the fluid pressure in the head end of the motor communicated thereto through a plurality of orifices 51 provided in the check valve member.

The valve body is provided with another bore 52 disposed parallel to the bore 46. A pair of axially spaced annuluses 53 and 54 are formed therein with the annulus 53 being connected to the motor port 43 through a passage 56 while the annulus 54 is connected to the inlet-outlet port through a passage 57. The passages 56 and 57, annuluses 53 and 54 and bore 52 form a bypass flow path to transmit fluid exhausted from the head end of the hydraulic motor around the check valve member 44 with the fluid flow therethrough being controlled by a valve spool 58 which is slidably disposed in the bore 52. As hereinafter used, the term "closed position" refers to the position in which the valve spool blocks fluid flow between the annuluses while the term "opened position" refers to the position in which the valve spool permits fluid flow from the annulus 53 to the annulus 54 through a combined annular groove and metering slot configuration 60 formed in the spool.

The valve spool 58 is resiliently urged to the closed position by a spring 59 which circumscribes a reduced diameter stem 61 formed at one end of the spool and is disposed between an annular shoulder 62 formed on the spool and a block 63 sealingly fastened to the valve body. A second spring 64 concentrically circumscribes the spring 59 and resiliently urges a washer 66 into contact with a shoulder formed in the valve body, the washer being positioned to be contacted by the annular shoulder 62 of the spool when the spool is moved toward the opened position.

The valve spool 58 is provided with an axially extending bore 67 formed in the lower end of the spool as viewed in the drawing. A reaction slug 68 is slidably received in the bore forming a reaction chamber 69. A passageway 71 is formed in the spool and connects the annulus 53 with the reaction chamber. One end of the slug is in abutment with a block 72 which is sealingly fastened to the valve body 41 forming an actuating chamber 73 at the lower end of the spool. A port 74 is formed in the block and communicates the actuating chamber with the pilot line 37.

A bore 76 is formed in the block 63 coaxial with the valve spool 58 and slidably receives a piston 77 which has its lower end positioned for abutment with the stem of the valve spool 58. The diameters of the piston 77 and slug 68 are equal. A passageway 78 is formed in the body 41 and connects with a passage 79 formed in the block 63 to communicate the annulus 53 and thus the motor port 43 with a reaction chamber 80 formed above the piston. A check valve 81 is disposed in the passageway and is resiliently urged into seating engagement with a seat 82 to permit one-way communication of fluid from the annulus to the reaction chamber. A first orifice 83 connects the passageway between the seat and the annulus with an equalizing and signal line 84 extending between the two valve bodies 41, 41' while a second orifice 86 connects the passageway between the seat 82 and the reaction chamber with the equalizing and signal line.

A relief valve 87 is provided in the valve body 41 to limit the maximum load generated fluid pressure in the head end of the respective hydraulic motor 11 when the valve spool 58 is in its closed position.

Operation

While the operation of the present invention is believed clearly apparent from the foregoing description, further amplification will subsequently be made in the following brief summary of such operation. To raise the load, the pilot selector valve 33 is manually shifted to the right as viewed in the drawing to direct pilot pressure through the pilot line 36 to the left end of the main control valve 19 causing it to also be shifted to the right. The rightward shifting of the main control valve causes pressurized fluid to be directed from the pump 16 through the conduit 23 to the inlet-outlet ports 42, 42' of both valve bodies 41, 41'. The fluid in the inlet-outlet ports unseat the check valve members 44, 44' and passes through the motor ports 43, 43' to the head ends 13 of the hydraulic jacks 11 and 12 causing them to extend.

When the load has reached the desired height, the main control valve 19 is returned to its normal position by proper manipulation of the pilot selector valve 33, thus stopping fluid flow through the inlet-outlet ports 42, 42'. This allows the check valve members 44, 44' to seat against the seats 47, 47' to block fluid flow from the motor ports 43, 43' to the inlet-outlet ports. During the raising operation and when the control valve is in its neutral position, the valve spools 58, 58' are maintained in their closed position by the springs 59, 59'.

The load carried by the hydraulic motors 11 and 12 generate a pressure in the fluid in the head ends of the hydraulic motors and thus the motor ports 43, 43' connected thereto. The fluid pressure in the motor ports is communicated through the passageways 71, 71' to the reaction chambers 69, 69' above the slug 68, 68' thereby exerting a force on the valve spools 58, 58' in a direction for urging the valve spools towards their opened positions. However, simultaneously, the pressurized fluid is also transmitted through the passageways 78, 78', check valves 81, 81', and passages 79, 79' to the reaction chambers 80, 80' causing the pistons 77, 77' to exert a force on the valve spools in a direction for urging the valve spools towards their closed positions. With the piston and slug associated with each valve spool being equal in diameter and responsive to the same fluid pressure, the valve closing force and the valve opening force generated by the fluid pressure in the motor ports is substantially equal and therefore the valve spool is effectively balanced. Thus, the springs 59, 59' maintain the valve spools in their closed position.

Should the load be maintained in the elevated position for an extended time, small amounts of fluid may normally leak through the various valves in the system. When this occurs the orifices 83, 83' and the equalizing and signal line 84 permit the transfer of fluid from the head end of one of the hydraulic motors 11 or 12 to the head end of the other hydraulic motor through the related passages in the valve bodies 41, 41' to compensate for slight differences in the leakage rate and to equalize the pressure in the head end of the hydraulic motors.

To lower the load, the pilot selector valve 33 is shifted to the left to direct pilot fluid into the pilot line 37. Initially, the valve spools 58, 58' are moved toward the opened position against the bias of the springs 59, 59' until the annular shoulder 62, 62' engage the washers 66, 66'. Preferably, the main control valve 19 is also provided with a similar dual spring arrangement so that it is also shifted to a pre-opening position by a relative low pilot pressure and is subsequently moved to an open position slightly ahead of the valve spools being moved to their opened positions. As the pressure in the actuating chambers 73, 73' is increased by modulation of the pilot selector valve, the valve spools continue to move towards their opened position. Since, as previously described, the fluid pressure in the head ends 13 of the hydraulic motors 11 and 12, and thus the motor ports 43, 43', is substantially equal due to the cross flow through the equalizing and signal line 84, the force exerted on the opposite ends of the valve spools in response to the fluid pressure in the motor ports is also substantially equal so that the forces exerted on the opposite ends of the valve spools is also substantially equal.

However, due to manufacturing tolerances, one of the valve spools 58 or 58' may open prior to the other valve spool reaching its opened position. For example, assume that the valve spool 58' opens first. When this happens the fluid pressure in the head end 13 of the hydraulic lift motor 12 and thus the motor port 43' starts to decay with a corresponding build-up of fluid pressure in the head end of lift motor 11 and the motor port 43 creating a pressure differential in the fluid in the motor ports. The increase in fluid pressure in the motor port 43 does not affect the valve spool 58 since the pressurized fluid is transmitted through passageway 71 to the reaction chamber 69 and through passageway 78 and passage 79 to the reaction chamber 80 such that the valve opening force and the valve closing force exerted on the valve spool 58 are equal. However, with the fluid pressure in the motor port 43 being higher than the fluid pressure in the motor port 43', fluid flows from the passageway 78 through both orifices 83 and 86 into the equalizing and signal line 84, through the orifice 83' and the passageway 78' and into the motor port 43'. The fluid in the passage 79' and the reaction chamber 80' is in a substantially static condition and although there is no fluid flow through the orifice 86', fluid pressure is transmitted therethrough so that the fluid pressure in the passage 79' and the reaction chamber 80' is equal to the fluid pressure in the equalizing and signal line. With the two orifices 83 and 86 feeding fluid to the single orifice 83', the fluid pressure in the equalizing and signal line and thus the passageway 78' between the check valve 81' and piston 77' is proportional to the fluid pressure in the motor port 43 and is determined by the size of the orifices and the pressure differential between the fluid in the motor ports. Thus, the valve closing force exerted on the valve spool 58' by the piston 77' is responsive to the fluid pressure in the motor port 43 while the valve opening force exerted on the valve spool 58' is responsive to the fluid pressure in the motor port 43'.

For an understanding of the present invention, it is sufficient to state that fluid pressure in the equalizing and signal line 84 will be approximately 90% of the fluid pressure in the motor port 43. For example, if the fluid pressure in the motor port 43 is 3,000 psi and the fluid pressure in the motor port 43' is 2,000 psi, the fluid pressure in the equalizing and signal line will be approximately 2,700 psi. Since the fluid pressure acting on the piston 77' is greater than the fluid pressure in the passageway 71' and reaction chamber 69', the force exerted on the valve spool 58' toward the closed position is greater than the force exerted thereon toward the opened position. As a result, when the pressure differential develops between the motor ports the valve spool 58' is moved toward the closed position to block the flow of fluid from the motor port 43' and thus the head end of the hydraulic jack 12. In the mean time, the valve spool 58 continues to move towards the opened position as increasing fluid pressure is applied in the chamber 73 and is subsequently opened. In so doing, the fluid pressure in the head end of the lift motor 11 starts to decrease and the fluid pressure differential between the motor ports decreases, the valve closing force exerting on the valve spool 58' by the piston 71' decreases proportionately permitting the valve spool 58' to reopen substantially simultaneously with the opening of the valve spool 58.

In view of the foregoing, it is readily apparent that the structure of the present invention provides an improved load check and bypass valve which is used in a hydraulic load lifting system in pairs to minimize the differential in the fluid pressures between the load supporting ends of a pair of hydraulic lift motors. This is accomplished by controlling the fluid exhausted from the load supporting ends of the motors individually with separate bypass valves and providing means responsive to the load generated fluid pressure in the load supporting ends of the hydraulic motors, and more particularly to pressure differentials induced therein by one of the bypass valves opening ahead of the other bypass valve, to close the opened bypass valve until the other valve also opens.

While the invention has been described and shown with particular reference to the preferred embodiment, it will be apparent that variations might be possible that would fall within the scope of the present invention which is not intended to be limited except as defined in the following claims.

What is claimed is:

1. In a hydraulic load lifting system including a source of fluid supply, a pair of hydraulic lift motors each having a load supporting end, a pair of load check valves individually connected to the load supporting means of the motors, each of the check valves being connected to the source of fluid supply for providing substantially unrestricted fluid flow therethrough from the source of fluid supply to the load supporting ends of the motors while blocking reverse fluid flow therethrough, the improvement comprising:

a pair of bypass valves connected to the source of supply and individually connected to the load supporting ends of the motors for controlling the flow of fluid exhausted from the load supporting ends of the motors to the source of fluid supply, each of the bypass valves being movable between an opened position at which fluid is free to flow therethrough from the load supporting end of the respective motor to the source of fluid supply and a closed position at which fluid flow therethrough is blocked;

first means responsive to the load generated fluid pressure in the load supporting end of the motors for exerting a valve opening force on the respective bypass valve;

second means responsive to the load generated fluid pressure in the load supporting end of one of the motors for exerting a valve closing force on the associated one of the bypass valves;

third means responsive to the load generated fluid pressure in the load supporting end of the other of the motors for exerting a valve closing force on the other of the bypass valves; and fourth means connecting the second means to the third means for communicating the load generated fluid pressure in the load supporting end of said one motor to said third means so that the valve closing force exerted on both of said bypass valves is responsive to the load generated fluid pressure in the load supporting end of said one motor.

2. The hydraulic load lifting system of claim 1 wherein each of the bypass valves includes a valve spool movable along its axis for establishing the closed and opened positions and means for resiliently biasing the spool to its closed position, and including selectively controllable actuating means for moving the valve spool toward its opened position.

3. The hydraulic load lifting system of claim 2 wherein the first means includes a pair of first force exerting means each of which is associated with one of the spools for exerting a force thereon in a direction towards its opened position, and a pair of first passage means individually connecting the load supporting ends of the motors with the first force exerting means.

4. The hydraulic load lifting system of claim 3 wherein the second and third means each include second force exerting means for exerting a force on the respective spool in a direction toward its closed position, second passage means individually connecting the load supporting ends of the motors with the respective second force exerting means, and a check valve disposed in the second passage means for providing fluid flow through the passage means from the load supporting end of the respective hydraulic motor to the respective second force exerting means.

5. The hydraulic load lifting system of claim 4 wherein each of the first force exerting means includes a reaction slug and means forming a bore in one end of the spool with the bore slidably receiving the reaction slug forming a reaction chamber therein, and each of the first passage means includes a passageway formed in the spool to communicate the load supporting end of the respective motor with the reaction chamber.

6. The hydraulic load lifting system of claim 5 wherein each of the second force exerting means includes a piston positioned for abutment with the other end of the valve spool and a reaction chamber associated with the piston, each of the second passage means being connected to the reaction chamber.

7. The hydraulic load lifting system of claim 6 wherein the selectively controllable actuating means includes means forming an actuating chamber at said one end of the valve spool and including a source of pilot fluid, a pilot selector valve connected to the source of pilot fluid and to the actuating chamber for selectively directing pilot fluid thereto.

8. The hydraulic load lifting system of claim 7 wherein the source of fluid supply includes a reservoir, a pump connected to the reservoir for drawing fluid therefrom, a control valve connected to the pump for receiving fluid therefrom and connected to the reservoir for returning fluid exhausted from the motors thereto, and conduit means connecting the control valve with the load check valves and bypass valves.

9. The hydraulic load lifting system of claim 4 wherein the fourth means includes a pair of orifices each being connected to the respective second passage means at a position between the check valve and the second force exerting means, and a line extending between and interconnecting the orifices.

10. In a load check and bypass valve including an inlet-outlet port, a motor port connected to said inlet-outlet port, a check valve positioned between said inlet-outlet port and said motor port, bypass means connected to said motor port and said inlet-outlet port and having a valve spool positioned in parallel to said check valve and being movable along its axis between a closed position at which fluid flow through the bypass means is blocked and an opened position at which fluid is free to flow through the bypass means, and selectively controllable actuating means for moving the valve spool to its opened position, said check valve being movable between a first position at which fluid is free to flow from the inlet-outlet port to the motor port at all positions of the valve spool and a second position at which fluid flow between the motor port and inlet-outlet port is blocked, the improvement comprising:

first force exerting means for exerting a force on the valve spool in a direction towards its first position, said first force exerting means including a stationary reaction slug, means forming a bore in one end of the valve spool with the bore slidably receiving the reaction slug, and forming a reaction chamber in the valve spool;

first passage means connecting the motor port with the first force exerting means, said first passage means including a passageway formed in the valve spool for connecting the motor port with the reaction chamber;

second force exerting means for exerting a force on the valve spool in a direction towards its closed position;

second passage means connecting the motor port with the second force exerting means;

a check valve disposed in the second passage means and movable between a first position at which fluid is free to flow from the motor port to the second force exerting means and a second position at which reverse fluid flow therethrough is blocked; and an orifice in communication with the second passage means between the check valve in the second passage means and the second force exerting means for restricting fluid flow from the second passage means at the first position of the check valve in the second passage means.

11. The load check and bypass valve of claim 10 wherein the second force exerting means includes a piston positioned for abutment with the other end of the spool and a second reaction chamber operatively associated with the piston, the second passage means being connected to the second reaction chamber.

12. The load check and bypass valve of claim 10 including a second orifice in fluid communication with the motor port for limiting fluid flow from the motor port.

13. The hydraulic load lifting system of claim 10 including another pair of orifices each being connected to the respective second passage means between the check valve and the load supporting end of the respective motor, said other orifices being connected to said line.

* * * * *